US006469268B1

(12) United States Patent
Schaeffeler et al.

(10) Patent No.: US 6,469,268 B1
(45) Date of Patent: Oct. 22, 2002

(54) ELECTRICAL SWITCH

(75) Inventors: Alois Schaeffeler, Spaichingen (DE); Alfons Steidle, Spaichingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 09/744,390

(22) PCT Filed: Jul. 9, 1999

(86) PCT No.: PCT/DE99/02151

§ 371 (c)(1),
(2), (4) Date: Jan. 24, 2001

(87) PCT Pub. No.: WO00/07201

PCT Pub. Date: Feb. 10, 2000

(30) Foreign Application Priority Data

Jul. 24, 1998 (DE) ..... 198 33 296

(51) Int. Cl.[7] ..... H01H 13/02
(52) U.S. Cl. ..... 200/522; 200/405
(58) Field of Search ..... 200/522, 332.2, 200/405

(56) References Cited

U.S. PATENT DOCUMENTS 3,536,973 A * 10/1970 Matthews et al. ..... 318/345
3,755,640 A * 8/1973 Kaman et al. ..... 200/157
3,777,092 A * 12/1973 Yeske ..... 200/172 R
3,961,146 A * 6/1976 Dummer ..... 200/157
4,061,895 A 12/1977 Hults
4,149,053 A * 4/1979 Long ..... 200/157
5,075,604 A * 12/1991 Crook et al. ..... 318/17
5,380,971 A * 1/1995 Bittel et al. ..... 200/536

FOREIGN PATENT DOCUMENTS

| | | |
|---|---|---|
| DE | 1 285 593 | 12/1968 |
| DE | 31 26 816 C2 | 1/1983 |
| DE | 33 38 244 C2 | 5/1985 |
| FR | 2 362 483 | 3/1978 |

* cited by examiner

*Primary Examiner*—Lincoln Donovan
*Assistant Examiner*—Lisa N Klaus
(74) *Attorney, Agent, or Firm*—Morgan, Lewis & Bockius LLP

(57) ABSTRACT

An electrical switch which can be used in particular in power tools, such as drilling machines, angle grinders or the like, is disclosed. The switch has an actuator, at least one fixed contact, and at least one switching contact. The switching contact is arranged on a slide which is moveable between two positions by means of the actuator. The switching contact is at a distance from the fixed contact in the one position and bears against the fixed contact in the other position. An elastic device interacts with the slide, so that the slide can be changed over between the two positions with a type of snap movement. The elastic device may be a first spring, arranged on the slide, like a pressure-point spring. The first spring, during movement of the slide, interacts with a switching-point link, fixed relative to the slide, for generating a pressure point in such a way that a spring force is effective against the direction of movement of the slide up to the changeover point, which is reached when the pressure point has been overcome.

11 Claims, 8 Drawing Sheets

Switch off

ELECTRICAL SWITCH

BACKGROUND OF THE INVENTION

Figure 1:
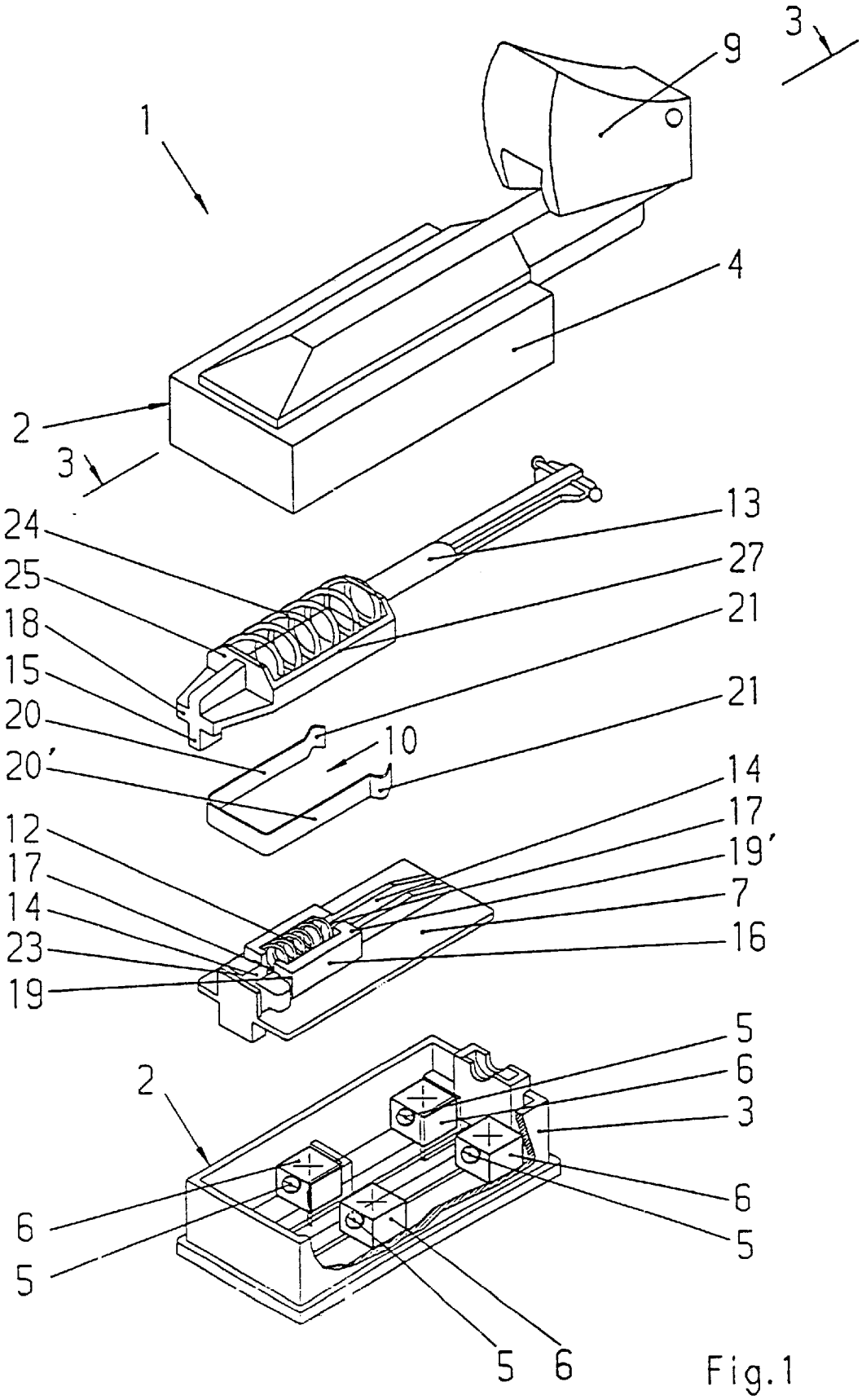

The present invention relates to an electrical switch, and more particularly an electrical switch for power tools.

FIELD OF THE INVENTION

Such electrical switches are used as ON/OFF switches in power tools, such as drilling machines, angle grinders or the like. In particular, the electric tools may be those which are operated with direct current.

DE 31 26 816 C2 discloses an electrical switch for electric tools. The switch has switching contacts like a contact bridge which are arranged on a slide and also associated fixed contacts. The slide can be moved between two positions by means of a manually actuable actuator. The switching contacts are at a distance from the fixed contacts in one position, namely the OFF position, and bear against the fixed contacts in the other position, namely the ON position. An elastic means designed as a torsion spring interacts with the slide and the actuator, so that the slide can be changed over between the two positions with a type of snap movement.

During the changeover between the two positions, considerable spring energy is stored in the torsion spring, this spring energy being introduced by the manual action on the actuator until the changeover point is reached. This spring energy is then released suddenly when the changeover point is crossed in the snap movement. It has now been found that chatter between switching and fixed contacts, in particular during the changeover from the OFF position into the ON position, may occur in the process, which has an adverse effect on the service life of the switch.

SUMMARY OF THE INVENTION

The object of the invention is to further develop the switch in such a way that its service life is prolonged and that, in particular, the contact chatter of the switch is reduced.

The elastic means of the switch according to the invention is designed as a first spring like a pressure-point spring. During movement of the slide, the first spring interacts with a switching-point link for generating a pressure point. As a result, a spring force acts against the direction of movement of the slide up to the changeover point, so that the movement of the slide from the OFF position into the ON position is first of all effected with a slow action while the switching contact approaches the fixed contact. Once the changeover point has been overcome, the distance still remaining between the switching point and the fixed contact is now covered with a snap movement of the slide. Since the snap movement is effected only when covering this very small distance, contact chatter is largely ruled out. Further refinements of the invention are described below.

It is especially preferred to design the elastic means as a combination of the first spring and a further second spring located on the slide. During movement of the slide, the second spring produces a further spring force, the further spring force acting against the direction of movement of the slide up to the changeover point and in the direction of movement of the slide when the changeover point has been overcome, so that the second spring therefore has an assisting action during the snap movement of the slide. During the changeover from the ON position into the OFF position, the slide first of all remains stationary, and thus the switching contact remains bearing against the fixed contact until the changeover point is reached. When the changeover point has been overcome, an abrupt separation of the switching contact from the fixed contact is then effected by the snap movement of the slide, so that arcs which may possibly occur are immediately extinguished. Destruction of the contacts, in particular in direct-current operation, is thus effectively countered.

The second spring may be designed as a compression spring. During the movement of the slide from the one position, this compression spring is loaded during the generation of the pressure point until the changeover point is reached, so that a resetting force acts against the direction of movement of the slide. When the changeover point is overcome, the compression spring then relaxes, in the course of which a force acts in the direction of movement of the slide.

The manual actuation is transmitted from the actuator to the contact system by means of a sliding member for example. To this end, the sliding member, by acting on the second spring, is in operative connection both with the slide and with the actuator. The sliding member is arranged so as to be movable in a guide on the slide. Two extensions assigned to the slide are located on the sliding member, in which case, on the one hand, the extensions interact with the guide and, on the other hand, in each case one extension acts on one end of the second spring.

In a further refinement, a receptacle like a rectangular chamber for the second spring is located on the slide. The guide for the sliding member adjoins the receptacle on both sides. The receptacle has openings relative to the guide on these two sides in such a way that the respective extension located on the sliding member can be guided into the receptacle for acting on the associated end of the second spring.

Furthermore, in each case a stop may be arranged at the extension on the sliding member, this stop interacting with a corresponding stop on the receptacle, for example with the chamber wall located at the transition between the guide and the receptacle. There is preferably clearance of motion between the two corresponding stops, such that, when the sliding member is actuated, first of all the second spring is acted upon, and the slide can be moved from the one position in the direction of the other position by means of the associated corresponding stops after the clearance of motion has been overcome. This clearance of motion assists the sequence of movement during the changeover, in particular with regard to the snap movement and the abrupt contact separation during the changeover from the ON position into the OFF position.

In a further refinement, the first spring is designed as a leaf spring with an elastic leg. The leaf spring is arranged approximately parallel to the plane of motion of the slide. An approximately V-shaped lug is located at the end of the elastic leg, the V-shaped lug interacting with a corresponding extension of the switching-point link, the extension being located on an inner wall of the housing for the switch. The leaf spring is expediently designed in a bow shape with two elastic legs like a U. A holder for the leaf spring is arranged on the slide, the holder being located on that end of a part of the guide which is opposite the receptacle. The base of the U-shaped leaf spring can thus be inserted into the holder for fastening.

Finally, a further third spring, which is designed as a compression spring, may be arranged on the sliding member. One end of the third spring bears against a stop fixed to the sliding member and the other end of the third spring bears against a stop fixed to the housing. As a result, a resetting force comes into effect when the sliding member is actuated, this resetting force at the same time serving to reset the actuator as soon as the manual action on the actuator has ended. A type of rectangular chamber may be located on the sliding member for accommodating the third spring. It is then advisable for the stop fixed to the sliding member to be formed by a wall of the chamber, whereas the stop fixed to the housing projects into the chamber.

The switching contact itself is likewise provided with a compression spring, so that the switching contact can be brought to bear against the fixed contact by means of spring pressure in the ON position. In this case, the first and second springs are located on one side of the slide, whereas the switching contact is arranged on the other, opposite side of the slide. In particular, the first and second springs are located on that side of the slide which faces the sliding member, and the switching contact with its compression spring is located on that side of the slide which is facing away from the sliding member.

The first spring should expediently have such a spring constant that the spring force of the first spring exerted at the changeover point is at least as great as the sum of the spring forces which are exerted by the compression springs at all the switching contacts. This ensures immediate contact separation at the changeover point during the changeover from the ON position into the OFF position. Furthermore, it is expedient for the extension of the switching-point link to be of asymmetrical design with flanks having different slopes. In this case, the steeper flank faces the OFF position and the gentler flank faces the ON position. This ensures, on the one hand, that the slow-action contact approach already mentioned until the changeover point is reached is effected during the changeover from the OFF position into the ON position. On the other hand, it is also ensured that, in interaction with the force of the compression spring at the switching contact, a contact separation during the changeover from the ON position into the OFF position is ruled out before the changeover point is reached.

The advantages achieved with the invention consist in particular in the fact that chatter of the contacts during the switching from the OFF position into the ON position is largely avoided. When switching back from the ON position into the OFF position, rapid, sudden opening of the contacts is achieved, which reduces the contact erosion. The service life of the contacts is therefore prolonged compared with previous switches.

In particular during use of the switch for switching direct current, any arcs which occur are immediately extinguished. Destruction of the contacts by arc action is therefore effectively prevented. The switch according to the invention is therefore also suitable for large switching capacities.

The movable parts of the switch have less friction than hitherto. As a result, the wear is lower and the service life of the switch is further increased.

The switch according to the invention also advantageously has smaller hysteresis between the ON position and the OFF position than previous switches. As a result, the user senses the switching more uniformly.

Furthermore, the switch has a small number of parts, these parts being simple and cost-effective. In addition, the switch is simple to mount. The switch according to the invention can thus be manufactured in a cost-effective manner.

Figure 2:
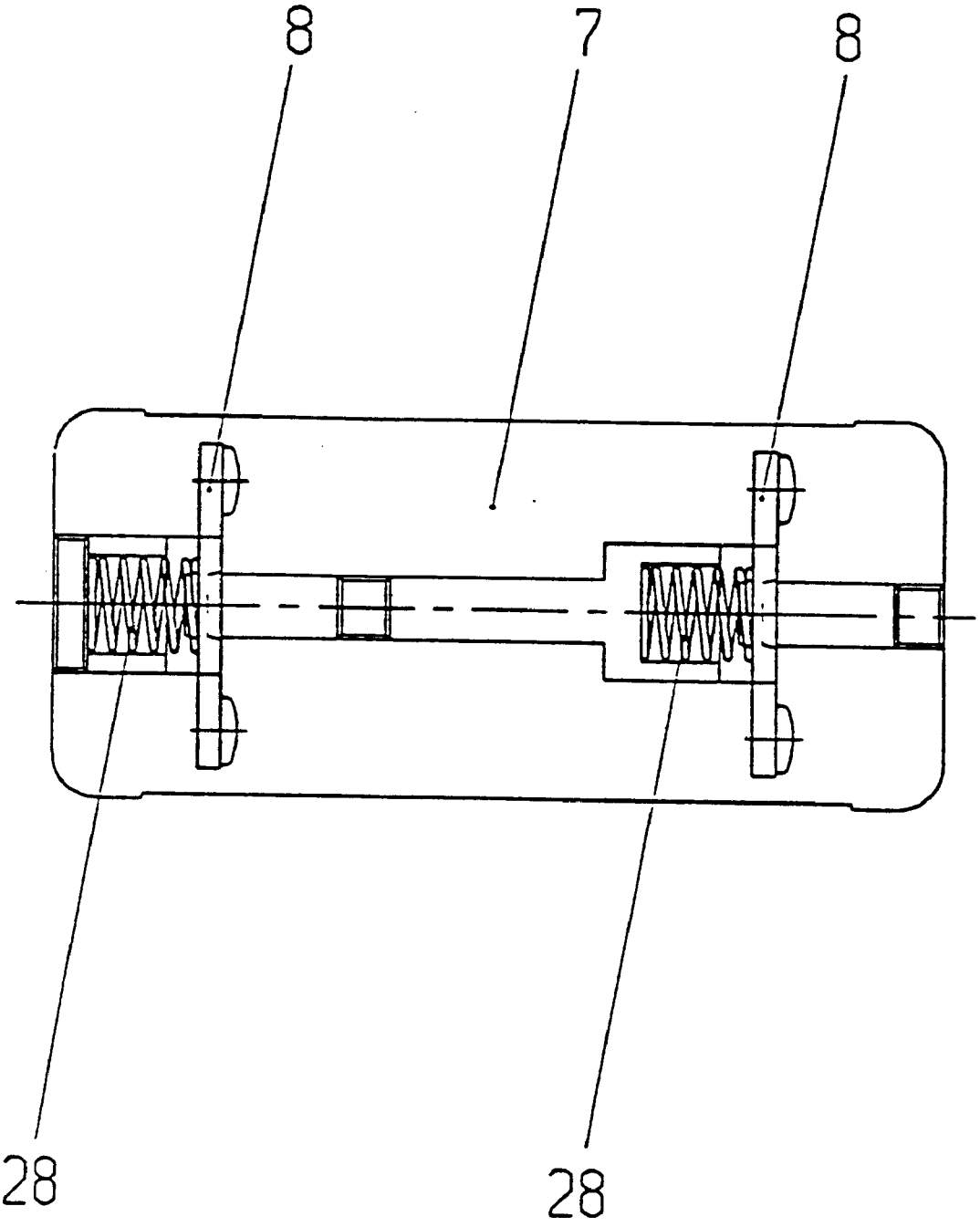
Figure 3:
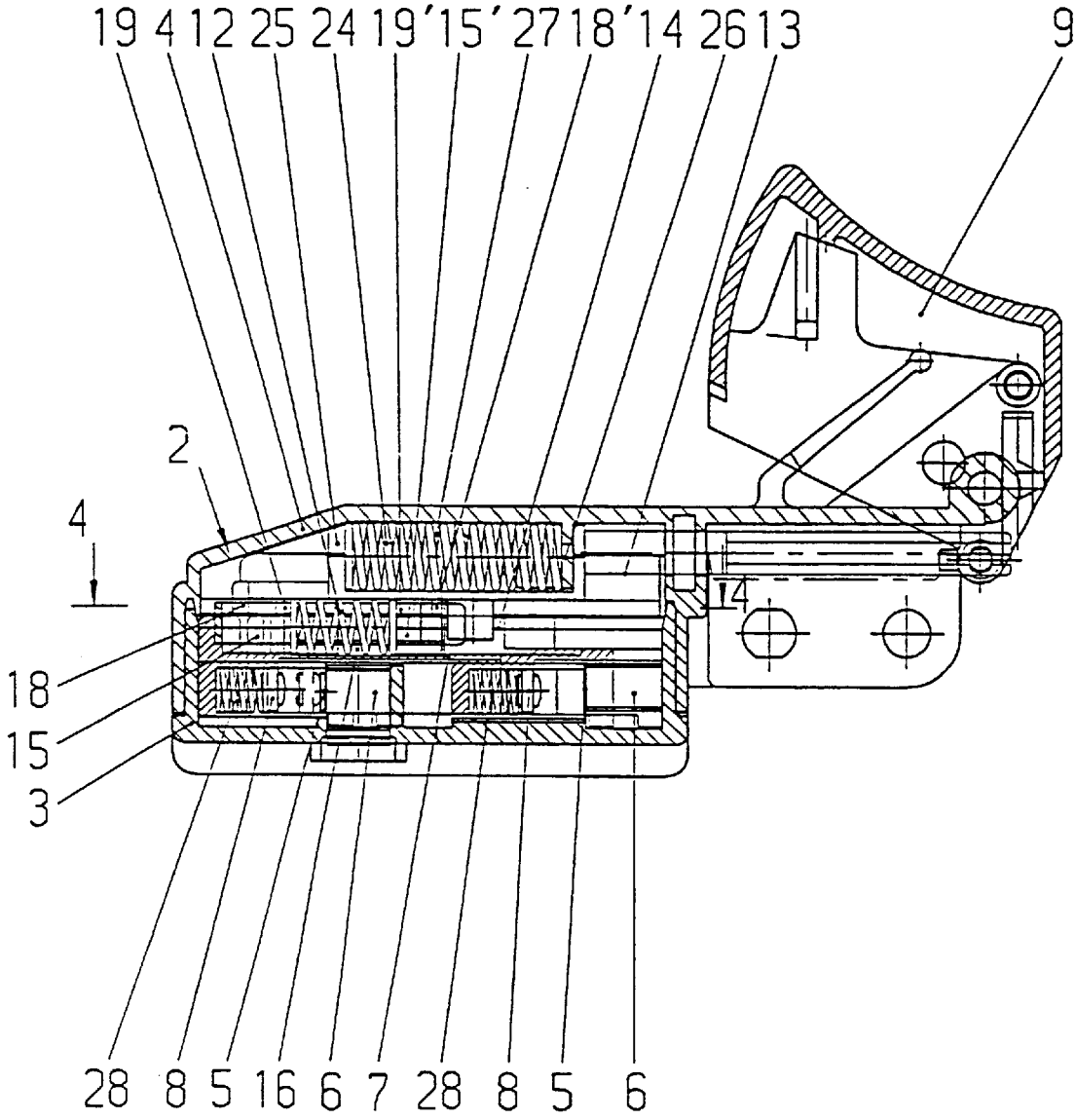
Figure 4:
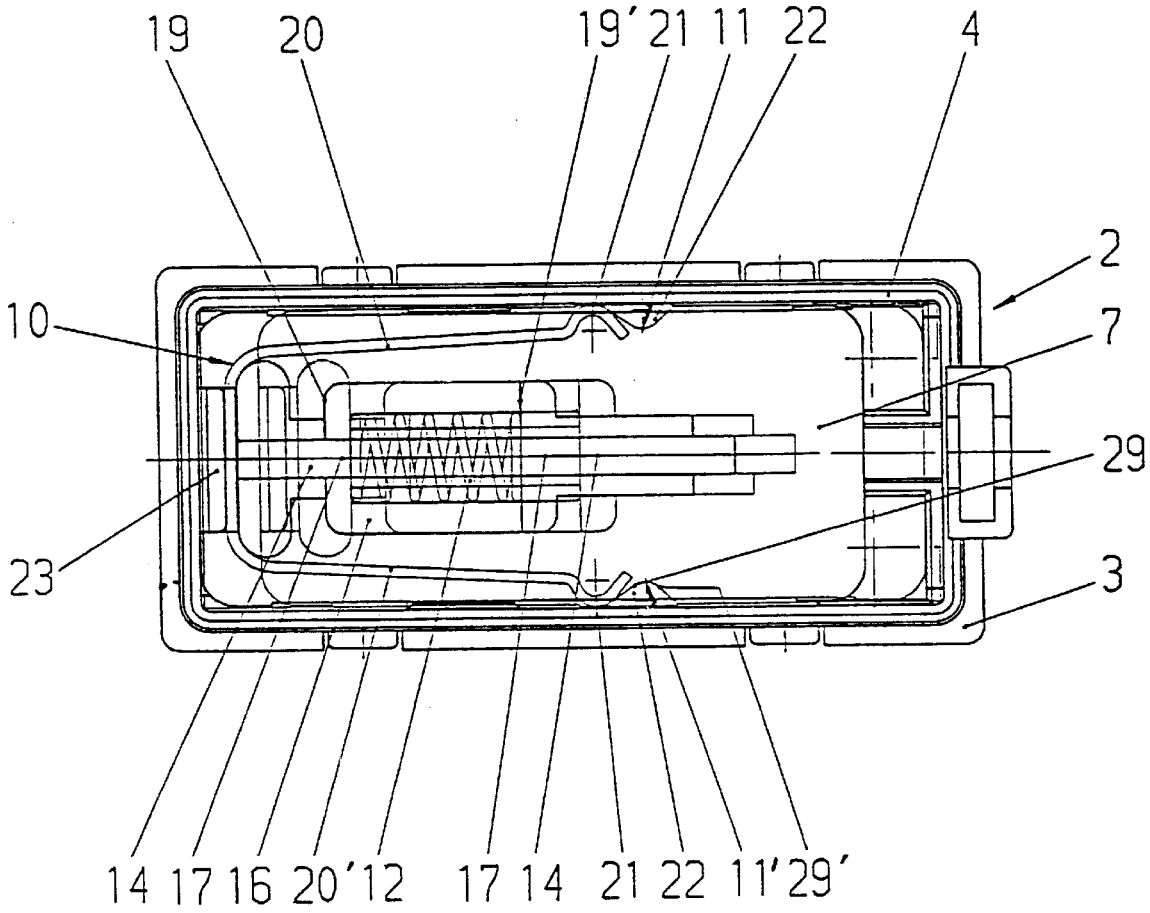
Figure 5:
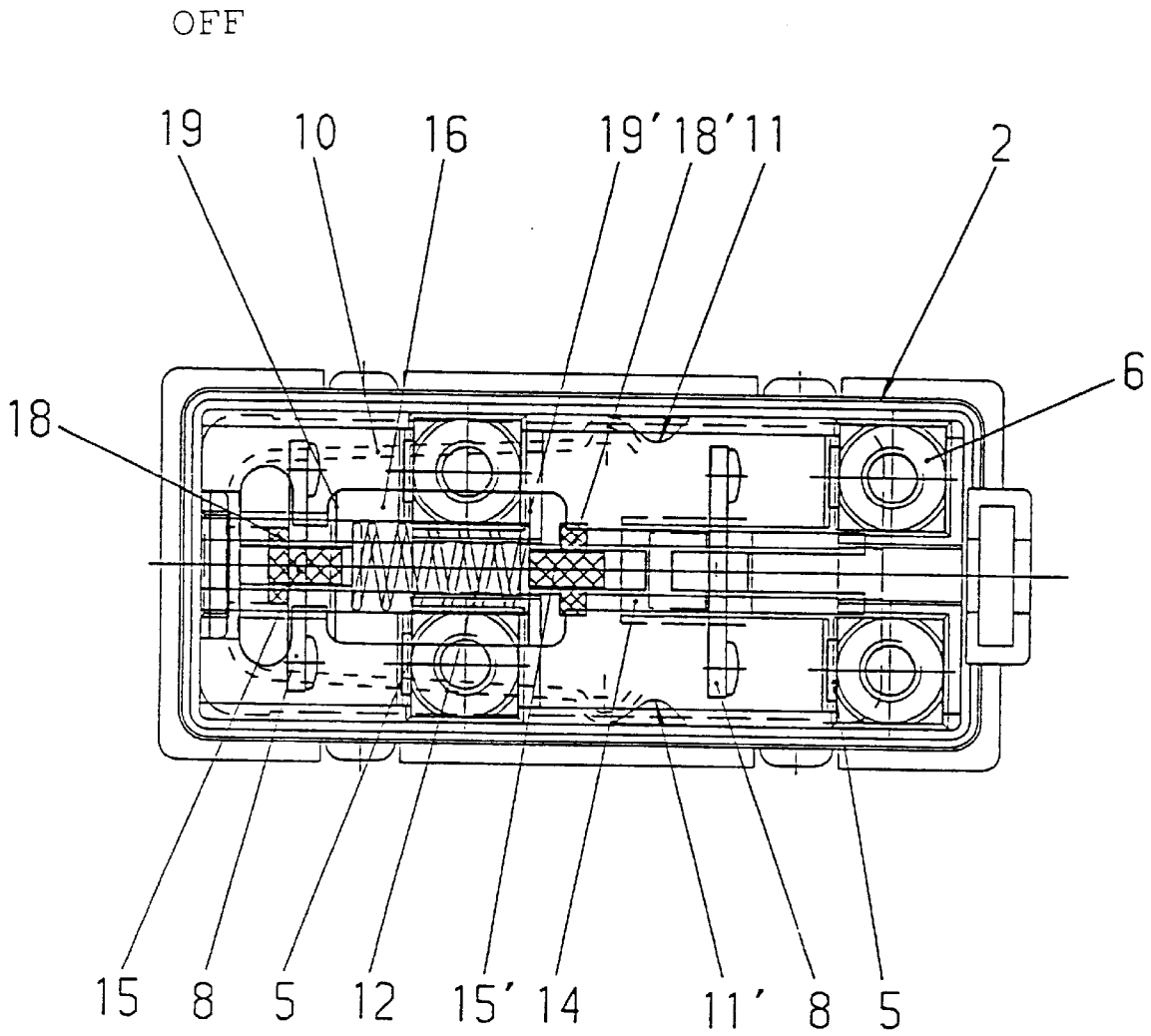
Figure 6:
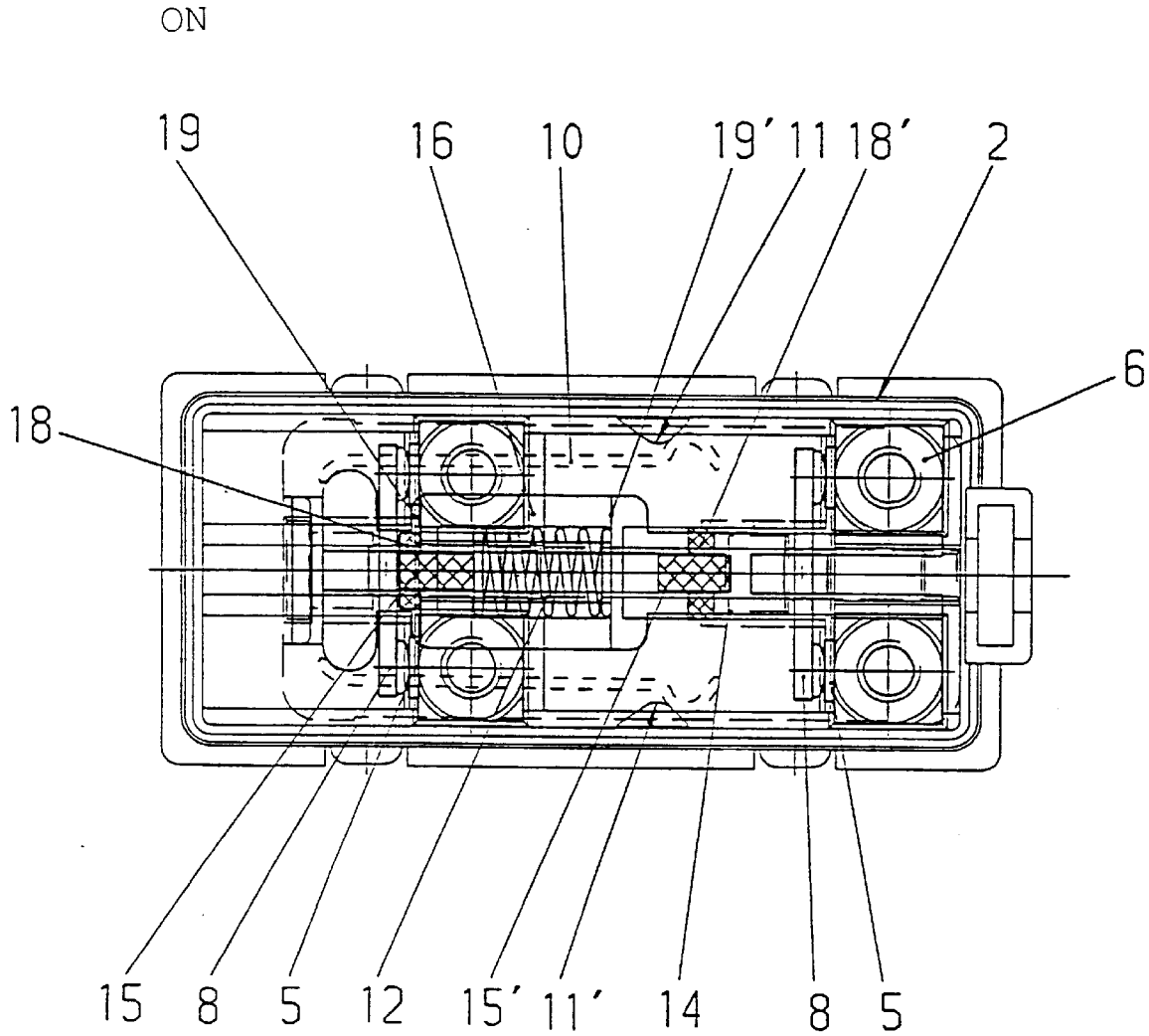
Figure 7:
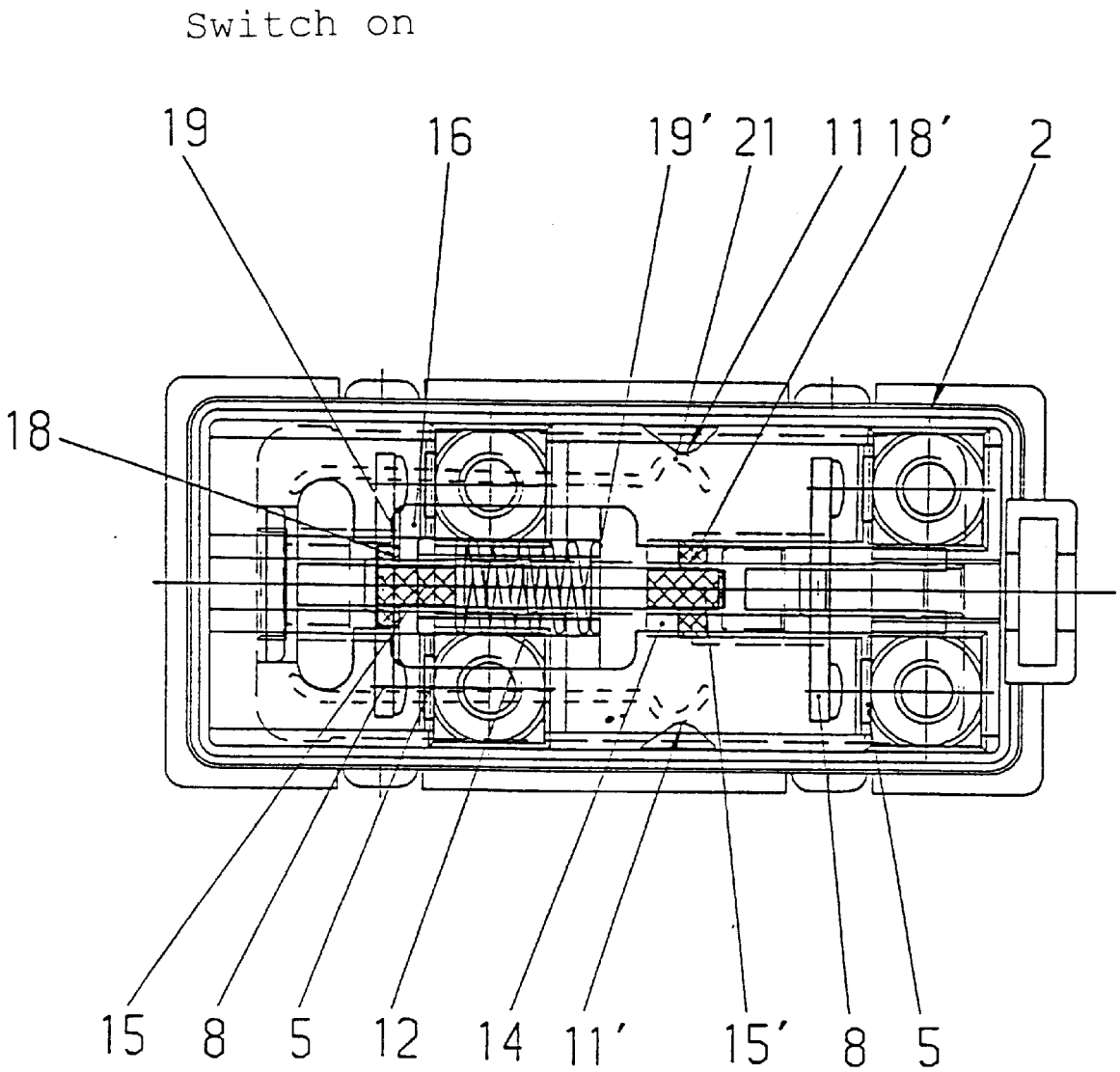
Figure 8:
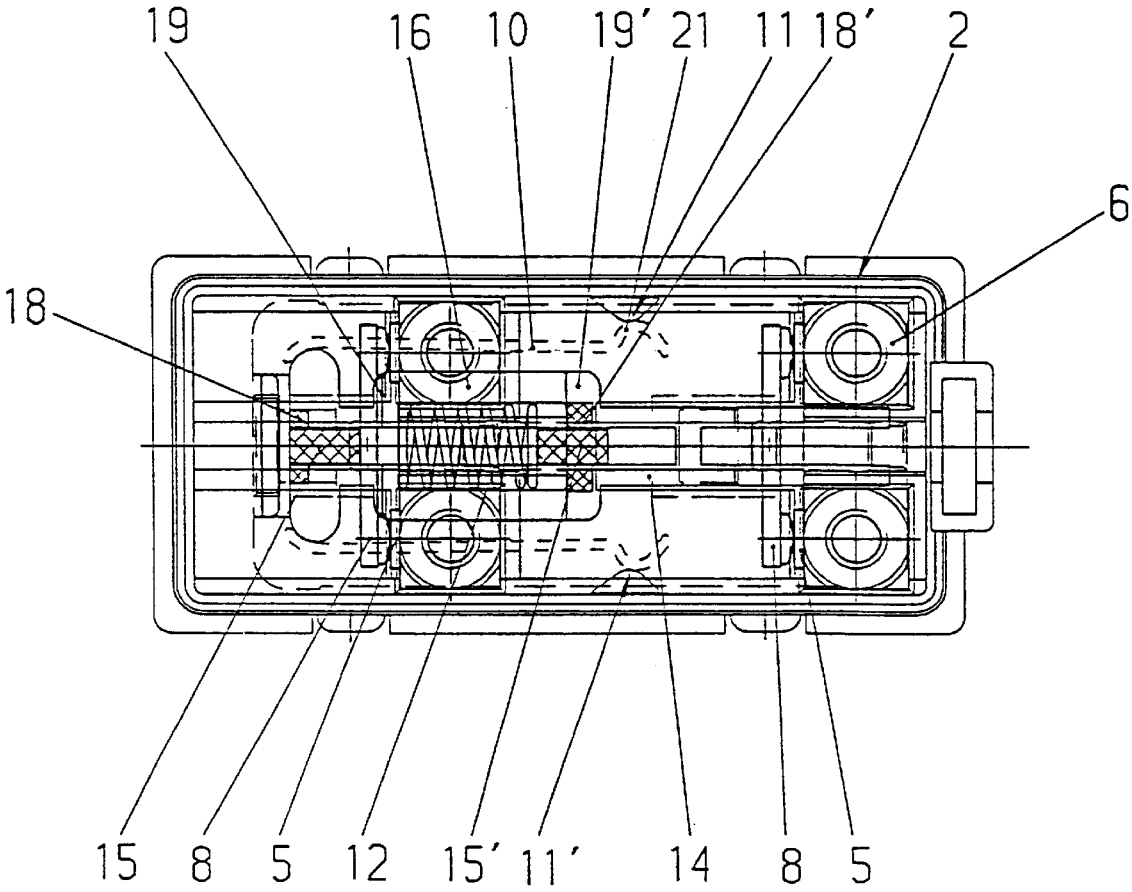

An exemplary embodiment of the invention with various developments is shown in the drawings and described in more detail below. In the drawings:

FIG. 1 shows an electrical switch in perspective exploded representation,

FIG. 2 shows the underside of the slide of the switch as an individual part, FIG. 3 shows a longitudinal section along line 3—3 from FIG. 1 through the switch, FIG. 4 shows a section along line 4—4 from FIG. 3, FIG. 5 shows the switch in the OFF position in accordance with a view as in FIG. 4, but in this case normally concealed functional parts are plainly shown, FIG. 6 shows the switch as in FIG. 5 in the ON position, FIG. 7 shows the switch as in FIG. 5 during the changeover from the OFF position into the ON position, and FIG. 8 shows the switch as in FIG. 5 during the changeover from the ON position into the OFF position.

DETAILED DESCRIPTION OF THE PREFERRED EMBODIMENTS

An electrical switch 1 which is used in electric tools can be seen in a schematic exploded representation in FIG. 1. The electric tools may be drilling machines, angle grinders or the like. In particular, the switch 1 is suitable for powerful electric tools which are operated with direct current.

The switch 1 has a housing 2 consisting of a base 3 and a lid 4. At least one fixed contact 5 is arranged in the base 3. In this case, a total of four fixed contacts 5 are arranged, so that two current paths can be switched with the switch 1. The fixed contacts 5 are located on electrical connections 6, with which the feed lines in the electric tool to the electrical switch 1 can be connected. Located in the housing 2 is a slide 7, on whose underside (which can be seen in FIG. 2) at least one switching contact 8 is arranged. In this case, the switch 1 has two switching contacts 8 for the two current paths.

Arranged on the lid 4 of the switch 1 is an actuator 9, by means of which the slide 7 can be moved between two positions. In one position, namely the first position or OFF position shown in FIG. 5, the switching contact 8 is at a distance from the fixed contact 5, so that the switch 1 is switched off. In the other position, namely the second position or ON position show in FIG. 6, the switching contact 8 bears against the fixed contact 5, whereby the switch 1 is switched on. As can readily be seen in FIG. 6, it is preferable to design the switching contact 8 like a contact bridge, which in the second position bridges in each case two associated fixed contacts 5.

Interacting with the slide 7 is an elastic means, which is designed as a first spring 10, arranged on the slide 7, like a pressure-point spring. A switching-point link 11, which can be seen in more detail from FIG. 4, is located in the lid 4. During the movement of the slide 7, which is produced by actuating the actuator 9, the first spring 10 now interacts with the switching-point link 11, which is fixed relative to the slide 7, for generating a pressure point in such a way that a spring force is effective against the direction of movement of the slide 7 up to the changeover point, which is reached when the pressure point has been overcome.

After overcoming the changeover point, the stored spring energy of the first spring 10 is released, so that the slide 7 can be changed over between the two positions with a type of snap movement.

Various developments of the switch 1 according to the invention are described in more detail below.

As can be seen in FIG. 1, a further, second spring 12 is arranged on the slide 7, and this second spring 12 produces an additional spring force during the changeover or during movement of the slide 7. This additional spring force acts against the direction of movement of the slide up to the changeover point. When the changeover point has been overcome, this further spring force then acts in the direction of movement of the slide 7. As a result, the snap movement of the slide 7 is assisted. It is especially preferred to design the elastic means which interacts with the slide 7 as such a combination of the first spring 10 and the second spring 12.

The second spring 12 is designed as a compression spring. During the changeover or during movement of the slide 7 from the one position, the second spring 12 is loaded during the generation of the pressure point until the changeover point is reached. As a result, a resetting force acts against the direction of movement of the slide 7. When the changeover point has been overcome, the second spring 12 then relaxes in such a way that a force acts in the direction of movement of the slide 7. This force causes the slide 7 to be shifted into the other position with a type of snap movement or also assists the snap movement on account of the first spring 10.

A sliding member 13 serves to transmit the actuation of the actuator 9 to the slide 7, the sliding member 13 being in operative connection with the actuator 9 for acting on the second spring 12. The sliding member 13 is arranged so as to be movable in a guide 14 on the slide 7. Two extensions 15, 15' assigned to the slide 7 are located on the sliding member 13, as can be seen with reference to FIG. 3. The extensions 15, 15' interact with the guide 14, so that the sliding member 13 is guided in the direction of movement of the slide 7. In each case one extension 15, 15' acts on one end of the second spring 12.

A receptacle 16 for the second spring 12 is located on the slide 7. As can be seen from FIG. 1, the receptacle 16 is configured like a rectangular chamber. The guide 14 for the sliding member 13 adjoins the receptacle 16 on both sides. Furthermore, the receptacle 16 has openings 17 relative to the guide 14 on both sides, so that the respective extension 15, 15' located on the sliding member 13 can be guided into the receptacle 16 for acting on the associated end of the second spring 12.

A stop 18, 18' is arranged on the sliding member 13, specifically one stop 18, 18' at each extension 15, 15'. The stop 18, 18' interacts with a corresponding stop 19, 19' on the receptacle 16. The stop 19, 19' may be the chamber wall located at the transition between the guide 14 and the receptacle 16. There is clearance of motion between the two corresponding stops 18, 19 and 18', 19' respectively, such that, when the sliding member 13 is actuated, first of all the second spring 12 is acted upon, and the slide 7 can be moved from the one position in the direction of the other position only after the clearance of motion has been overcome.

In one refinement, the first spring 10 is designed as a leaf spring with an elastic leg 20, as can be seen in more detail in FIG. 4. The leaf spring 10 is arranged approximately parallel to the plane of motion of the slide 7. An approximately V-shaped lug 21 is located at the end of the elastic leg 20. The V-shaped lug 21 interacts with a corresponding extension 22 on the switching-point link 11. The extension 22 is located on an inner wall of the housing 2 for the switch 1, specifically on the lid 4.

As can also be seen from FIG. 4, the leaf spring 10 is preferably designed in a bow shape with two elastic legs 20, 20' like a U. In this case, each elastic leg 20, 20' interacts with a switching-point link 11, 11' on the two inner walls of the housing 2 opposite one another. For fastening, a holder 23 for the leaf spring is arranged on the slide 7. The holder 23 is located on that end of a part of the guide 14 which is opposite the receptacle 16. As a result, the base of the U-shaped leaf spring 10 can be inserted into the holder 23.

Finally, a further third spring 24, which can be seen in FIG. 3 and is designed as a compression spring, may be arranged on the sliding member 13. One end of the third spring 24 bears against a stop 25 fixed to the sliding member and the other end of the third spring 24 bears against a stop 26 fixed to the housing. As a result, a resetting force comes into effect when the sliding member 13 is actuated. A type of rectangular chamber 27 shown in FIG. 1 is expediently located on the sliding member 13 for accommodating the third spring 24, the stop 25 fixed to the sliding member being formed by a wall of the chamber 27. The stop 26 fixed to the housing is fastened to the lid 4 and projects into the chamber 27, as can again be seen from FIG. 3.

As can be seen in particular from FIG. 2, the switching contact 8 is provided with a compression spring 28. As a result, the switching contact 8 can be brought to bear against the fixed contact 5 by means of spring pressure. Whereas the first spring 10 and the second spring 12 are located on one side of the slide 7, specifically on that side of the slide 7 which faces the sliding member 13, the switching contact 8 together with the compression spring 28 is arranged on the other opposite side of the slide 7, specifically on that side of the slide 7 which is facing away from the sliding member 13.

The first spring 10 is preferably selected with such a spring constant that the spring force of the first spring 10 exerted at the changeover point is at least as great as the sum of the spring forces which are exerted by the compression springs 28 at all the switching contacts 8. Finally, as can be seen from FIG. 4, it is expedient that the extension 22 of the switching-point link 11, 11' is of asymmetrical design. The gentle flank 29 faces the first position, which is shown in FIG. 5 and in which the switching contact 8 is at a distance from the fixed contact 5. The steep flank 29' faces the position which is shown in FIG. 6 and in which the switching contact 8 bears against the fixed contact 5.

The switching operation of the switch 1 during the changeover is to be explained in more detail below.

If the switch 1 is in the OFF position according to FIG. 5, the actuator 9 is manually actuated by the user for switching on. In the process, the sliding member 13, with its extension 15, first of all acts on the left-hand end of the second spring 12, whereby the latter is loaded. After the clearance of motion has been overcome, the stop 18 on the extension acts on the corresponding stop 19 of the receptacle 16 and moves the slide 7 to the right in the direction of the ON position. On account of the gentle flank 29 (see FIG. 4) and the opposed spring force of the first spring 10, this movement is effected with a slow action until the changeover point is reached, as can be seen in FIG. 7. After the changeover point has been crossed, the energy stored in the first and second springs 10, 12 is abruptly released and the slide 7 moves with a snap action to the right. In the process, the ON position shown in FIG. 6 is reached, the compression spring 28 (see FIG. 3) being loaded on account of the switching contact 8 bearing against the fixed contact 5.

To switch off, the user releases the actuator 9, so that the latter is reset by the sliding member 13 on account of the resetting force of the third spring 24 (see FIG. 3). During the resetting movement of the sliding member 13, the extension 15' first of all acts on the right-hand end of the second spring 12 and loads the second spring 12 while utilizing the clearance of motion. In the process, the slide 7 remains stationary like a freewheel, and the ON position shown in FIG. 6 between switching contact 8 and fixed contact 5 is retained. The stop 18' of the extension 15' then acts on the corresponding stop 19', in the course of which the slide 7, on account of the steep flank 29' (see FIG. 4) and the opposed spring force of the first spring 10, moves at most slightly to the left in the direction of the OFF position. On account of the spring force of the relaxing compression spring 28 (see FIG. 3) on the switching contact 8, however, the switching contact 8 remains bearing against the fixed contact 5, and the ON position is therefore retained until the changeover point is reached, as can be seen in FIG. 8. After the changeover point has been crossed, the energy stored in the first and second springs 10, 12 is again abruptly released, and the slide 7 then moves with a snap action to the left, the switching contact 8 being abruptly separated from the fixed contact 5 and the OFF position shown in FIG. 5 being reached.

The invention is not restricted to the exemplary embodiment shown and described. On the contrary, it also comprises all developments by the person skilled in the art within the scope of the idea behind the invention. For instance, the switch according to the invention may be used not only in electric tools but also in electrical garden implements, electrical household appliances or the like.

What is claimed is:

1. An electrical switch, comprising:

an actuator, at least one fixed contact, a slide carrying at least one switching contact movable between two positions by means of the actuator, the at least one switching contact being at a distance from the at least one fixed contact in a first position and the at least one switching contact bearing against the at least one fixed contact in a second position, and an elastic means interacting with the slide, so that the slide is changed over between the two positions with a snap movement, wherein the elastic means comprises a first spring, arranged on the slide and the first spring, during movement of the slide, interacts with a switching-point link, fixed relative to the slide, for generating a pressure point in such a way that a spring force is effective against the direction of movement of the slide up to the changeover point, which is reached when the pressure point has been overcome.

2. The electrical switch according to claim 1, wherein a second spring is arranged on the slide, and this second spring produces a second spring force during the changeover, the second spring force acting against the direction of movement of the slide up to the changeover point and in the direction of movement of the slide when the changeover point has been overcome.

3. The electrical switch according to claim 2, wherein the second spring comprises a compression spring, and during the changeover from the first position, the second spring is loaded during the generation of the pressure point until the changeover point is reached in that a resetting force acts against the direction of movement of the slide and when the changeover point has been overcome, the second spring then relaxes so that a force acts in the direction of movement of the slide.

4. The electrical switch according to claim 2, wherein a sliding member is in operative connection both with the slide, for acting on the second spring, and with the actuator, wherein the sliding member is arranged so as to be movable in a guide on the slide, in that, two extensions assigned to the slide are located on the sliding member, the extensions interacting with the guide, and in each case one extension also acts on one end of the second spring.

5. The electrical switch according to claim 4, wherein a receptacle for the second spring is located on the slide, wherein the guide for the sliding member adjoins the receptacle on both sides, and the receptacle has openings relative to the guide on both sides in such a way that the respective extension located on the sliding member is guided into the receptacle for acting on the associated end of the second spring.

6. The electrical switch according to claim 5, wherein a stop is arranged on the sliding member at each extension, the stop interacting with a corresponding stop on the receptacle, the corresponding stop is the chamber wall located at the transition between the guide and the receptacle, and there is clearance of motion between the two corresponding stops, such that, when the sliding member is actuated, the second spring is acted upon, and the slide is moved from the first position in the direction of the second position after the clearance of motion has been overcome.

7. The electrical switch according to claim 6, wherein the first spring comprises a leaf spring with an elastic leg, the leaf spring being arranged parallel to the plane of motion of the slide, a V-shaped lug is located at the end of the elastic leg and the V-shaped lug interacts with a corresponding extension on the switching-point link, the extension being located on an inner wall of the housing for the switch.

8. The electrical switch according to claim 7, wherein the leaf spring comprises a bow shape with two elastic legs, each elastic leg interacting with the switching-point link on the two inner walls of the housing opposite one another, wherein a holder for the leaf spring is arranged on the slide, the holder also being located on that end of a part of the guide which is opposite the receptacle, the base of the leaf spring is inserted into the holder.

9. The electrical switch according to claim 8, wherein a third spring, comprises a compression spring, is arranged on the sliding member, one end of the third spring bearing against a stop fixed to the sliding member and the other end of the third spring bearing against a stop fixed to the housing in such a way that a resetting force comes into effect when the sliding member is actuated, wherein a rectangular chamber is located on the sliding member for accommodating the third spring, the stop fixed to the sliding member being formed by a wall of the chamber, and the stop fixed to the housing projecting into the chamber.

10. The electrical switch according to claim 9, wherein the at least one switching contact is provided with a compression spring, so that the at least one switching contact is brought to bear against the at least one fixed contact by means of spring pressure, and the first spring and the second spring are located on one side of the slide, and the at least one switching contact is located on the opposite side of the slide, the first and second springs are located on that side of the slide which faces the sliding member, and the at least one switching contact is located on that side of the slide which is facing away from the sliding member.

11. The electrical switch according to claim 10, wherein the first spring has a spring constant that the spring force of the first spring exerted at the changeover point is at least as great as the sum of the spring forces which are exerted by each compression spring at each switching contact, wherein the extension of the switching-point link is of asymmetrical design with flanks having different slopes, the gentle flank facing the first position in which the at least one switching contact is at a distance from the at least one fixed contact, and the steep flank facing the second position in which the at least one switching contact bears against the at least one fixed contact.

* * * * *